US006406017B1

(12) United States Patent
Yaneda

(10) Patent No.: US 6,406,017 B1
(45) Date of Patent: Jun. 18, 2002

(54) RECORDING MEDIUM TRANSPORTATION APPARATUS

(75) Inventor: Takeshi Yaneda, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/616,717

(22) Filed: Jul. 14, 2000

(30) Foreign Application Priority Data

Jul. 16, 1999 (JP) ..... 11-203777

(51) Int. Cl.[7] ..... B65H 5/02
(52) U.S. Cl. ..... 271/276; 271/196
(58) Field of Search ..... 271/276, 196, 271/197

(56) References Cited

U.S. PATENT DOCUMENTS 2,813,637 A * 11/1957 Perry et al.
3,593,990 A * 7/1971 Gilly et al.
4,307,661 A * 12/1981 Wilkins et al. ..... 271/197 X
4,997,178 A * 3/1991 Ogoda ..... 271/276
5,730,440 A * 3/1998 Motooka ..... 271/276
5,810,350 A * 9/1998 Pollich ..... 271/276
6,254,092 B1 * 7/2001 Yraceburu et al. ..... 271/276

FOREIGN PATENT DOCUMENTS

JP 6-135613 5/1994

* cited by examiner

*Primary Examiner*—David H. Bollinger
(74) *Attorney, Agent, or Firm*—Dike, Bronstein, Roberts & Cushman IP Group Edwards & Angell, LLP; David G. Conlin; David A. Tucker

(57) ABSTRACT

In a recording medium transportation apparatus that transports a recording medium held attracted to a belt by air suction, the recording medium can be transported stably with generation of curling at the side end of the recording medium suppressed. A plurality of suction holes generating suction force by air suction are formed at the belt. A plurality of suction holes extending in one row over the belt running direction form hole rows. Each hole row is set to be located corresponding to the width dimension of a paper sheet of the size of A3, B4, A4, B5 defined by the Japanese Industrial Standard and post card. When a sheet of respective size is placed on the belt, the side end of the width direction is drawn by suction holes.

14 Claims, 12 Drawing Sheets

RECORDING MEDIUM TRANSPORTATION APPARATUS

BACKGROUND OF THE INVENTION

1. Field of the Invention

The present invention relates to a recording medium transportation apparatus incorporated in an image recording apparatus that performs image formation such as printing on a recording medium such as a sheet of paper. Particularly, the present invention relates to improvement of an apparatus using a belt drive device and generating suction force by air suction at the belt surface to transport a recording medium held on the belt by the suction force.

2. Description of the Background Art

Conventionally, printers and copy machines are known as the equipment of performing image formation such as printing on a recording medium such as a sheet of paper or film. A belt drive device is employed as the means to transport a recording medium in such equipment.

A general structure of an ink jet type printer transporting a recording medium using a belt drive device will be described hereinafter.

As shown in FIG. 13, this type of belt drive device includes a drive roller 101, a driven roller 102 and a tension roller 103. An endless belt 104 is extended around rollers 101, 102 and 103. Drive roller 101 is connected to a drive shaft of a motor not shown to rotate by the transmission of the drive force of the motor. Belt 104 runs in the direction of arrow A in FIG. 13 in accordance with the rotation of drive roller 101. Pinch rollers 105, 105 sandwiching belt 104 between drive roller 101 and driven roller 102 are provided at the upper area in FIG. 13 opposite to drive roller 101 and driven roller 102, respectively. A sheet cassette 106 is arranged in the proximity of driven roller 102. A recording medium (paper sheet) 107 output from sheet cassette 106 is transported in the direction of arrow A in accordance with the run of belt 104 while being sandwiched with belt 104 between driven roller 102 and pinch roller 105.

A printer head 108 is provided above the portion of belt 104 located between drive roller 101 and driven roller 102 (this portion of belt 104 is called "span" 104*a* hereinafter). Printer head 108 is configured of the line type head or serial type head. A line type head includes a plurality of spray out nozzles corresponding to the resolution across the required printing width (for example, approximately 200 mm in printing out onto a A4-size paper sheet) in a direction perpendicular to the paper plane of FIG. 13. A serial type head includes several ten to several hundred of spray nozzles in the direction of A in FIG. 13 to effect printing on a recording medium 107 while moving in the direction perpendicular to the paper plane of FIG. 13.

In a printing operation, recording medium 107 is output from sheet cassette 106 in accordance with the drive of the belt drive device. Recording medium 107 is transported in the direction of arrow A in a status sandwiched with belt 104 between driven roller 102 and pinch roller 105.

In the case where printer head 108 is of the line type, ink is output appropriately from each spray out nozzle of printer head 108 while recording medium 107 is continuously transported. As a result, printing is effected on recording medium 107.

In the case where printer head 108 is of the serial type, the travel of belt 104 is temporarily halted when recording medium 107 is transported to the position where printer head 108 is disposed. Ink is output from the spray out nozzle while printer head 108 moves in the direction perpendicular to the paper plane of FIG. 13, whereby printing is effected on recording medium 107. When printer head 108 comes to one side end of recording medium 107, belt 104 begins to move again. After recording medium 107 is shifted by a predetermined distance, belt 104 stops again. The printing operation is recommenced while printer head 108 moves in the direction perpendicular to the paper plane of FIG. 13. Thus, the printing operation by printer head 801 and the operation of moving recording medium 107 by the belt drive device are carried out alternately to effect printing onto recording medium 107.

In this type of device, a configuration of drawing recording medium 107 towards belt 104 is employed to transport recording medium 107 stably on belt 104. More specifically, a platen chamber 109 is provided at the backside of span 104*a* of belt 104 located between drive roller 101 and driven roller 102. Platen chamber 109 has suction holes 110, 110, . . . formed at the top surface. Air suction is effected through suction holes 110, 110, . . . by setting the interior to negative pressure. Also, a plurality of suction holes (not shown) are formed at belt 104. Recording medium 107 is attracted to belt 104 by the air suction from the suction hole in accordance with the generation of negative pressure within platen chamber 109. Accordingly, position shifting of recording medium 107 on belt 104 is prevented to allow a stable transportation operation of recording medium 107.

In the following, the force suppressing recording medium 107 from floating or curling, i.e. the force to draw recording medium 107 is called "suction force" whereas the holding force acting between recording medium 107 and belt 104 is called "attracted force", and distinction is made therebetween.

When the structure in which recording medium 107 adheres to belt 104 by air suction is employed, the total area of the suction holes covered by recording medium 107 becomes larger if the size of recording medium 107 transported on belt 104 is big enough. In other words, the total area of suction holes not covered by recording medium 107 (suction holes not contributing to attraction) becomes smaller. Therefore, the suction resistance at the suction holes of belt 104 becomes larger, so that a great suction force can be obtained. As a result, recording medium 107 adheres to belt 104 favorably to allow a stable transportation operation.

If recording medium 107 transported on belt 104 is small in size, the total area of suction holes covered by recording medium 107 becomes smaller. In other words, the total area of suction holes not covered by recording medium 107 becomes larger. There is a possibility that a stable transportation operation cannot be performed due to the smaller suction force.

Japanese Patent Laying-Open No. 6-135613 discloses a transportation apparatus directed to solve the above problem. This transportation apparatus is provided with a valve that opens/closes each suction hole of the platen chamber. Open/close control of the valve is provided so that only the suction holes corresponding to the passage of the recording medium are opened. Accordingly, a stable transportation operation of a recording medium can be carried out with a constant high suction force.

The conventional structure of holding the recording medium by air suction has been developed directed to only ensure a high suction force. No consideration was made as to the suction position.

When the suction hole of the belt is located at a position outside the side end of the recording medium, no suction force will be effected on the side end area. There is a possibility of this area will float upwards off the belt. In some cases, this portion may rise to be curled. Generation of such a curl induces the possibility that a printing operation will not be carried out satisfactorily due to the recording medium coming into contact with the printer head to be smudged or causing sheet jamming. This phenomenon is particularly significant in the case where a relatively small recording medium is transported that has the tendency of a lower suction force.

In the case of a serial type printer head, the deliver operation and halt operation of the recording medium are carried out alternately in the transportation operation of an apparatus including this type of head. High accuracy is required in the transportation amount of the recording medium. In order to achieve transportation of high accuracy, the side end of the recording medium must adhere to the belt reliably to prevent position shifting between the recording medium and the belt.

SUMMARY OF THE INVENTION

In view of the foregoing, an object of the present invention is to prevent generation of a curl in a recording medium and allow the recording medium to be transported at high accuracy in a recording medium transportation apparatus that transports the recording medium held adhered to the belt by air suction.

To this end, the suction hole of a belt formed to attract the recording medium by air suction is located facing the side end of the recording medium in the present invention. Generation of a curl is suppressed by the side end of the recording medium adhering to the belt.

According to an aspect of the present invention, a recording medium transportation apparatus includes a suction chamber drawing in air, and a transportation belt with a surface to transport a recording medium. A plurality of suction holes to introduce air into the suction chamber are formed at the surface of the transportation belt. At least a portion of the suction holes at the transportation belt is formed located opposite to the side end region of the transported recording medium to attract that side end region.

In the recording medium transportation apparatus that transports a recording medium held attracted on the belt by air suction of the present invention, the suction holes of the belt formed to attract the recording medium by air suction is positioned to face the side end region of the recording medium. Therefore, the side end region of the recording medium can be held against the belt in a favorable manner to prevent the recording medium from being curled upwards. By applying this recording medium transportation apparatus into an image recording apparatus, the problem that a favorable printing operation cannot be performed due to the recording medium coming into contact with the printer head to be contaminated or occurrence of sheet jamming can be eliminated. As a result, a stable image formation operation can be carried out to improve the picture quality of the image formed on the recording medium. Particularly in the case where a relatively small recording medium (post card or B5-size sheet) that has the tendency of smaller suction force is transported, the side end of the recording medium can be held towards the belt in a favorable manner to effectively prevent generation of a curl. The present invention can sufficiently respond to the demand for an image recording apparatus that includes a serial type printer head that must have the side end of the recording medium adhere to the belt reliably for the purpose of ensuring a transportation amount of high accuracy corresponding to the alternate operation of forwarding and stopping the recording medium. Position shifting between the recording medium and the belt can be prevented to improve the picture quality of the image that is formed on the recording medium.

Preferably, the recording medium transportation apparatus of the present invention further includes a roller to drive the transportation belt. The transportation belt is an endless transportation belt. This endless transportation belt has a span for the transportation of a recording medium. A plurality of suction holes are formed at the surface of the endless transportation belt. At least a portion of the suction holes of the endless transportation belt is formed at a position facing the side end region of the recording medium placed on the span to attract that side end region.

Preferably, the plurality of suction holes form a plurality of rows of holes arranged linearly substantially parallel to the transportation direction of the recording medium. Also preferably, the plurality of suction holes form a plurality of rows of holes arranged linearly substantially perpendicular to the transportation direction of the recording medium. Further preferably, the plurality of suction holes are arranged in a staggered pattern.

Preferably, at least a portion of the plurality of suction holes forms a row of holes arranged linearly so as to face the side end region of a recording medium located substantially parallel to the transportation direction of the recording medium placed on the span. Further preferably, a plurality of rows of holes are arranged parallel to each other so as to face the side end region of respective recording media of a plurality of sizes.

In this case, the side end of the recording medium parallel to the transportation direction can be held against the belt to prevent this side end from curling. Particularly in the case where a plurality of rows of holes are arranged so as to be able to correspond to respective recording media of different sizes, the above-described advantage can be provided for the recording medium of each size with the same belt. Thus, the versatility of the apparatus can be improved.

Preferably, the total opening area of suction holes of at least one row differs from the total opening area of suction holes of another row. Also preferably, the total opening area of suction holes of at least one row is larger than the total opening area of suction holes of another row. Further preferably, the total opening area of suction holes in respective rows becomes smaller as located closer to the outer side of the transportation belt in a direction substantially perpendicular to the transportation direction of the recording medium.

By the features of the present invention, appropriate suction force can be generated at each row of holes. Particularly in the case where the total opening area of suction holes of a certain row is set larger than the total opening area of suction holes of another row, the suction force of that certain row can be made larger than the suction force of holes of another row. When the total opening area of suction holes of respective rows is set smaller as a function of location closer to the outer side of the belt in the belt width direction, the total area of suction holes occluded by the recording medium can be set relatively large even when a relatively small recording medium is transported. Therefore, sufficient suction force can be generated. In the case where a relatively large recording medium is transported, sufficient suction force can be generated since this type of recording medium inherently has a large total area of suction holes occluded. Therefore, sufficient suction force can be obtained for a recording medium of any size.

Suction holes of a different size can be arranged alternately in at least one row of holes in the transportation direction of the recording medium.

Preferably, at least a portion of a plurality of suction holes forms a row of holes arranged linearly so as to face the side end region of a recording medium located substantially perpendicular to the transportation direction of the recording medium placed on the span. Also preferably, at least a portion of the plurality of suction holes forms a row of holes arranged linearly so as to face the side end region of the leading edge in the transportation direction of a recording medium placed on the span. Further preferably, at least a portion of the plurality of suction holes forms a row of holes arranged linearly so as to face the side end region of the trailing edge in the transportation direction of the recording medium placed on the span.

In this case, the side end of the leading edge or the trailing edge of the recording medium side in the transportation direction can be held against the belt.

Preferably, a plurality of rows of holes are arranged in the transportation direction of the recording medium so that the interval of suction holes in the transportation direction of the recording medium is substantially 1/an integer times the length of the recording medium in the transportation direction.

In this case, each suction hole formed along the transportation direction of the recording medium is located at an interval of "1/an integer times" the length of the recording medium in the transportation direction. In the status where the recording medium is transported with the leading edge portion facing the suction holes, the trailing edge portion of the recording medium can also be made to face the suction holes. Therefore, generation of a curl can be suppressed with respect to both the leading and trailing edges of the recording medium. In other words, by setting only the leading edge portion of the recording medium to face the suction holes, the trailing edge portion of the recording medium can also be made to face the suction holes without having to confirm the trailing edge portion. As a result, generation of a curl at both the leading and trailing edge portions of the recording medium in the transportation direction can be easily suppressed.

Preferably, the suction holes of the transportation belt are formed to face a recording medium at an inward position remote from the side end of the transported recording medium by a predetermined distance.

Preferably, the suction chamber has a surface facing the transportation belt. A plurality of suction holes are formed at the surface of the suction chamber. The plurality of suction holes have a shape elongated in the running direction of the transportation belt, and are arranged apart from each other across the width direction of the transportation belt. Further preferably, the interval between each of the plurality of suction holes of the suction chamber is substantially equal to the interval of the plurality of rows of suction holes in the width direction of the transportation belt.

Preferably, the recording medium transportation apparatus of the present invention further includes image formation means to form an image on a transported recording medium located on the span.

By applying the recording medium transportation apparatus of the present invention to the recording medium transportation system of an image recording apparatus, a specific application of a recording medium transportation apparatus can be obtained to improve practical usage thereof. Furthermore, an image of high picture quality can be formed by the image recording apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described with reference to the drawings. The present embodiment corresponds to the case where the present invention is applied to an ink jet type printer.

First Embodiment

Structure

Figure 1:
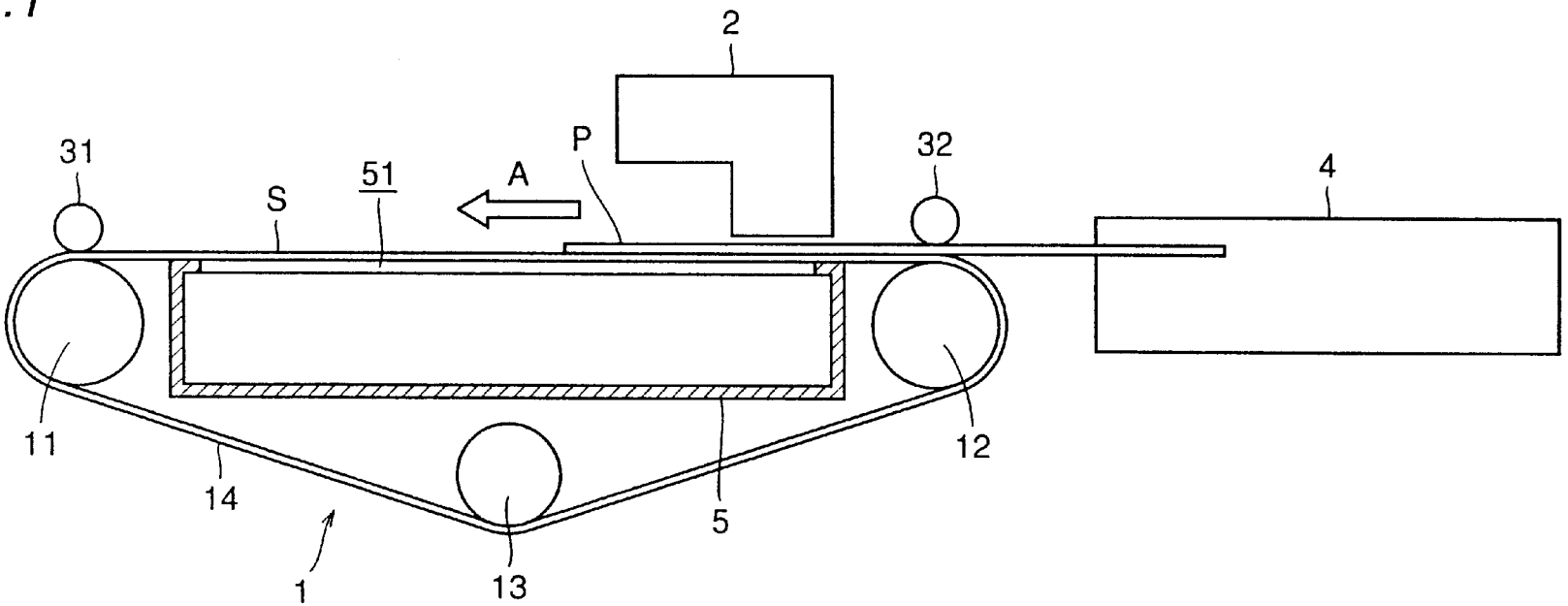
FIG. 1 shows a schematic structure of a transportation system and printing system of a printer according to a first embodiment of the present invention.

FIG. 1 shows a schematic structure of a transportation system of a paper sheet P as a recording medium and a printing system performing printing on transported paper sheet P in a printer of the present embodiment. The transportation apparatus to transport paper sheet P includes a belt drive device 1. Belt drive device 1 includes a drive roller 11, a driven roller 12 and a tension roller 13. An endless belt 14 is extended around rollers 11, 12 and 13. Drive roller 11 is connected to a drive shaft of a motor not shown to be rotated by the driving force of the motor. More specifically, belt 14 runs in the direction of arrow A in FIG. 1 in accordance with the rotation of drive roller 11. The foregoing motor is formed of, for example, a stepping motor to drive the roller intermittently at every predetermined step angle. Therefore, belt 14 runs intermittently cooperatively with the drive of the motor. Pinch rollers 31 and 32 are provided above to correspond to drive roller 11 and driven roller 12, respectively, in FIG. 1 so as to hold belt 14 between rollers 11 and 12.

A printer head 2 functioning as image formation means is provided above a span S of belt 14 located between drive roller 11 and driven roller 12. Printer head 2 is a serial type head, including several ten to several hundred spray out nozzles in the direction of A in FIG. 1 (direction of transportation of paper sheet P). Printer head 2 includes moving means not shown to allow travel in the direction perpendicular to the paper plane of FIG. 1. Printer head 2 includes respective cartridges of yellow, magenta, cyan and black to allow full color printing. These cartridges may be formed integrally or provided individually for each color.

A sheet cassette 4 in which a plurality of paper sheets P are stored is provided at the upstream side (right side in FIG. 1) of driven roller 12. Paper sheet P is stored in sheet cassette 4 so that the center axis of paper sheet P matches the center axis of sheet cassette 4 in the direction of transportation by a sheet guide not shown. A sheet feed roller not shown is provided at the sheet output side of sheet cassette 4. Paper sheet P is output one by one from sheet cassette 4 by this sheet feed roller to be supplied onto belt 14.

A platen chamber 5 is arranged at the backside of span S of belt 14 located between drive roller 11 and driven roller 12. Platen chamber 5 corresponds to a vessel of substantially a cuboid. The top surface of platen chamber 5 substantially matches the line connecting the top end of drive roller 11 and the top end of driven roller 12.

Figure 2:
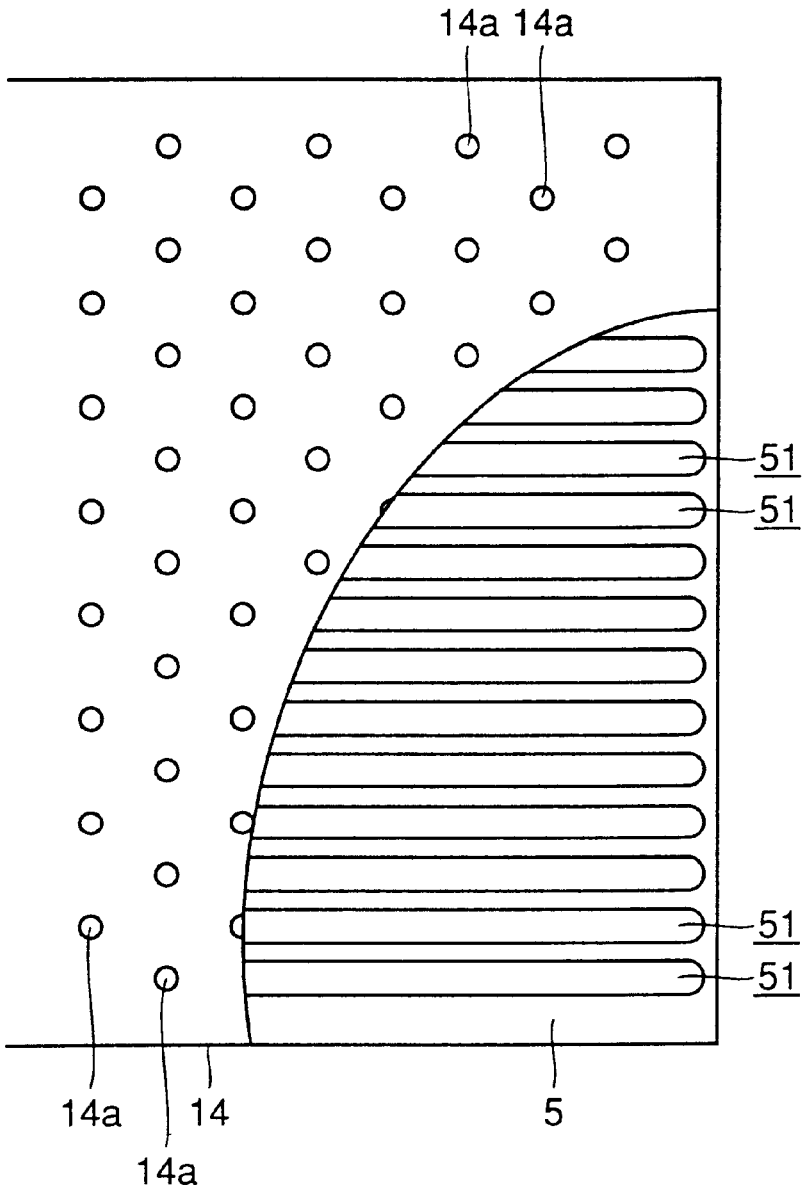
FIG. 2 is a plan view of a platen chamber and a belt of the first embodiment with a broken out section.

Platen chamber 5 has a plurality of suction holes 51, 51, . . . formed at the top surface, as shown in FIG. 2. Suction hole 51 is elongated in the running direction of belt 14 (horizontal direction in FIG. 2). Holes 15 are arranged at a predetermined interval in the direction of the belt width. A duct not shown is connected to platen chamber 5 from which air is discharged by the drive of a fan not shown located upstream of the duct. By the exhausted air, the interior of platen chamber 5 attains negative pressure (for example, approximately 100–600 Pa), whereby the suction force to draw paper sheet P towards belt 14 is generated.

Figure 3:
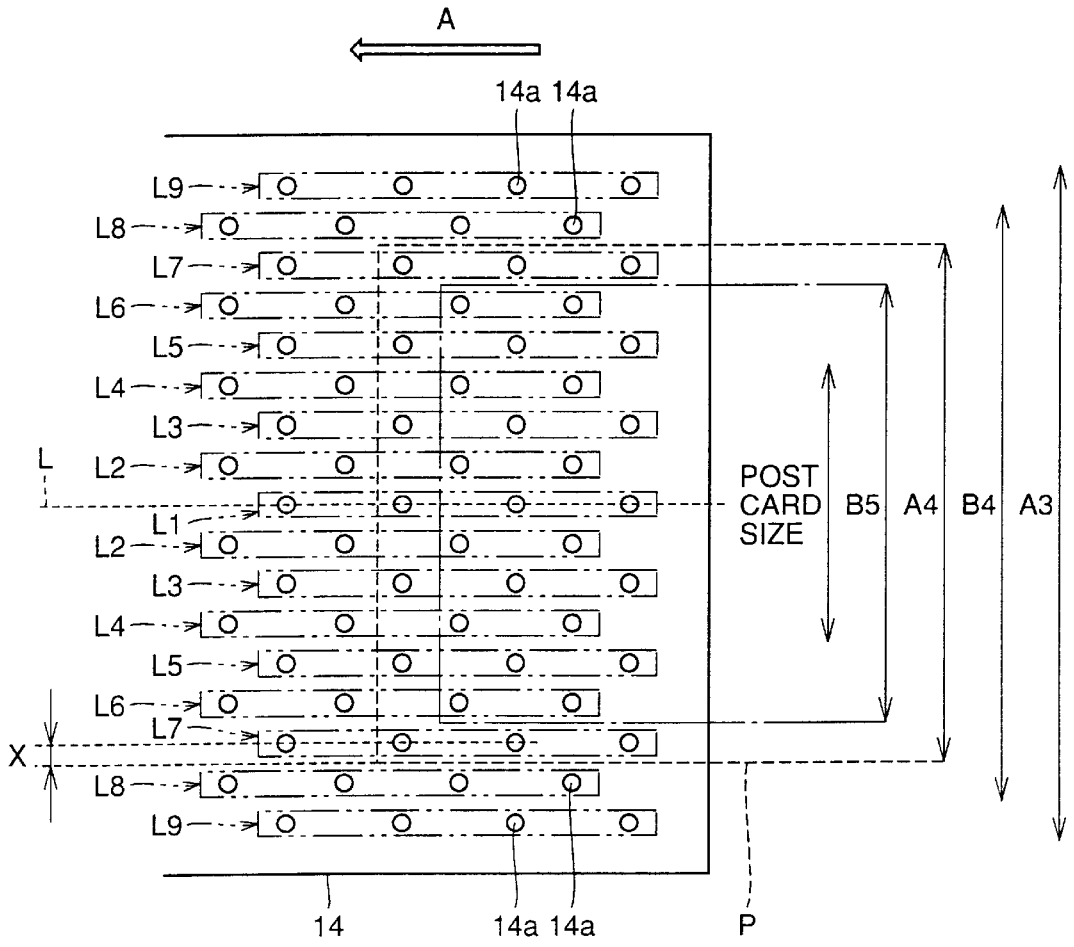
FIG. 3 is a plan view of the belt of the first embodiment.

As shown in FIGS. 2 and 3, a plurality of suction holes 14*a*, 14*a*, . . . are formed at belt 14. Suction hole 14*a* corresponds to a circular opening (for example, approximately 1–10 mm in diameter). In accordance with the drive of platen chamber 5, suction force to draw paper sheet P onto the surface of belt 14 is generated to avoid position shifting of paper sheet P with respect to belt 14. Therefore, a favorable transportation operation of paper sheet P can be performed. Suction holes 14*a* are formed at predetermined intervals (pitch) in both the longitudinal direction and width direction of belt 14. The pitch of suction holes 14*a*, 14*a*, . . . in the width direction of the belt matches the pitch of suction holes 51, 51, . . . formed at platen chamber 5.

Belt 14 is formed of a rubber material such as urethane rubber to achieve great friction between the surface of belt 14 and paper sheet P. Belt 14 is set to have the thickness of 0.5 mm, for example.

Position of Suction Hole

The present embodiment is characterized in the position where suction holes 14*a*, 14*a*, . . . are formed at belt 14.

Suction holes 14*a*, 14*a*, . . . are arranged in a staggered pattern. One portion of suction holes 14*a*, 14*a*, . . . is positioned corresponding to the width dimension of transported paper sheet P (the dimension of the shorter side of paper sheet P). More specifically, suction holes 14*a*, 14*a*, . . . are formed at the position corresponding to the width dimension (the dimension orthogonal to the belt running direction: the dimension in the vertical direction in FIG. 3) of the size of A3, B4, A4, B5 in accordance with the Japanese Industrial Standard (JIS) and post card size as the type of paper sheet P that can be transported by device 1. The position of the formed suction holes 14*a*, 14*a*, . . . corresponding to each size will be described hereinafter.

Suction holes 14*a*, 14*a*, . . . include a plurality of hole rows L1–L9 (each surrounded by a chain line with two dots in FIG. 3) disposed over the entire circumference of the belt in the running direction. On the transportation reference line L (indicated by the straight broken line in FIG. 3) located at the center in the width direction of belt 14 is formed the first hole row L1. The subsequent rows of holes L2–L9 are formed at a predetermined interval sequentially outwards in the direction of the belt width (vertical direction in FIG. 3), each centered about the first row of holes L1. In other words, the second hole rows L2 and L2 are formed at both sides of first hole row L1. The third hole rows L3 and L3 are arranged at the respective outer sides of second rows L2, L2. Accordingly, rows of holes corresponding to each sheet size are sequentially formed towards the outer side of belt 14. The ninth hole row L9 is formed at the outermost side.

For example, the row of holes corresponding to a paper sheet P of the A4 size is the seventh hole rows L7, L7. Since the width dimension of this A4-size paper sheet P is 210 mm, each seventh hole row L7 is located 100 mm away from transportation reference line L of belt 14 at either side in the width direction of belt 14. The broken line in FIG. 3 implies a A4-size paper sheet P placed on belt 14. With regards to the formation of seventh hole rows L7, L7 at this position, the distance X between both side ends in the width direction of A4-size paper sheet P and suction holes 14*a*, 14*a*, . . . forming the seventh hole rows L7 and L7 is approximately 5 mm. More specifically, the portion of the A4-size paper sheet P located 5 mm from either side in the width direction is drawn by the seventh row of holes L7, L7.

Similarly, the rows corresponding to a B5-size paper sheet P are the sixth hole rows L6, L6. Since a B5-size paper sheet P has a width dimension of 182 mm, the sixth rows L6, L6 are positioned 86 mm from transportation reference line L of belt 14 at either side in the width direction of belt 14. The chain line with one dot in FIG. 3 corresponds to a B5-size paper sheet P mounted on belt 14. With regards to formation of the sixth rows L6 and L6 at this position, the distance between the side ends of the B5-size paper sheet P in the width direction and suction holes 14*a*, 14*a*, . . . forming the sixth rows L6, L6 is also approximately 5 mm. More specifically, the portion of the B5-size paper sheet P located 5 mm from either side in the width direction is drawn by the suction holes of the sixth rows L6, L6.

The position of each row of holes is set for each sized paper sheet P so that the portion of paper sheet P located 5 mm from either side is attracted. Specifically, the fourth rows of holes L4, L4 correspond to the size of a post card. The eighth rows of holes L8, L8 correspond to a B4-size paper sheet. The ninth rows of holes L9, L9 correspond to a A3-size paper sheet P.

When a A4-size paper sheet P is transported with the longer side located along the width direction of the belt, respective side end portions of the A4-size paper sheet P in the direction of the longer side are drawn by the ninth rows of holes L9, L9 (located 143.5 mm at either side in the belt width direction from transportation reference line L) since the shorter side dimension of a A3-size paper sheet P is equal to the longer side dimension of a A4-size paper sheet P (both 297 mm). Similarly, when a B5-size paper sheet P is transported with the longer side along the belt width direction, respective side end portions of the B5-size paper sheet P in the longer side direction are drawn by the eighth rows of holes L8, L8 regarding the relationship between a B4-size sheet and a B5-size sheet.

The size of paper sheet P of device 1 is not limited to that described above. The so-called "legal size" can be employed in addition to the aforementioned sizes. The position of suction holes 14*a*, 14*a*, . . . are set appropriately corresponding to the desired size.

The size and shape of each of suction holes 14*a* and 51 of belt 14 and platen chamber 5, respectively, can be set arbitrarily. The pitch between suction holes 14*a* of belt 14 does not have to be equal in the longitudinal direction and the width direction of belt 14. The pitch can be different therebetween. Furthermore, the suction force of platen chamber 5, the thickness of paper sheet P, the mechanical characteristics, the surface status (different types such as normal paper, coated paper and the like), the sheet transportation speed and the like can be set arbitrarily.

Operation

An operation of a printer of the foregoing structure will be described hereinafter.

Upon initiation of a printer operation, the sheet feed roller not shown is driven to output paper sheet P from sheet feed cassette 4. The leading edge of paper sheet P is located between pinch roller 32 and belt 14. Under this state, the motor is driven to rotate drive roller 11. In accordance with rotation of drive roller 11, belt 14 runs in the direction of arrow A in FIG. 1.

Meanwhile, the fan of platen chamber 5 is driven to generate negative pressure within platen chamber 5. Accordingly, suction force is generated at the surface of belt 14. Paper sheet P adheres to belt 14 by this suction force. Therefore, paper sheet P is transported favorably without paper sheet P being offset in position with respect to belt 14.

During the transportation, the side portions in the width direction of paper sheet P will not rise off belt 14 since both side portions are drawn by the corresponding row of suction holes 14*a*, 14*a*, . . . due to the match of the center axis of sheet feed cassette 4 and the center axis of belt 14 in the transportation direction by a sheet feed guide. In other words, paper sheet P is transported on belt 14 without either edge portion curling upwards. In the case where a A4-size paper sheet P is transported as indicated by the broken line in FIG. 3, each of suction holes 14*a*, 14*a*, . . . of the first to seventh rows L1–L7 located below paper sheet P causes paper sheet P to be drawn. Each of suction holes 14*a*, 14*a*, . . . of the seventh row draws in the portion of paper sheet P located 5 mm from either side in the width direction. Therefore, both end portions of paper sheet P are held favorably on belt 14 to prevent curling upwards. When a B5-size paper sheet P is transported as indicated by the chain line with one dot in FIG. 3, each of suction holes 14*a*, 14*a*, . . . of the first to sixth rows L1–L6 located beneath paper sheet P causes paper sheet P to be drawn. Each side portion of paper sheet P is held favorably towards belt 1 by each of suction holes 14*a*, 14*a*, . . . of the sixth rows L6, L6. The same applies for transportation of a paper sheet P of another size. The portion of paper sheet P located 5 mm from either side in the width direction is drawn to prevent curling thereat.

When paper sheet P is transported to arrive at the position where printer head 2 is located, the drive of the motor is suppressed to cease the run of belt 14. Printer head 2 emits ink from the spray out nozzle while moving in the direction perpendicular to the paper plane of FIG. 1, whereby an image is formed on paper sheet P. When printer head 2 arrives at one end of paper sheet P, belt 14 moves again such that paper sheet P is delivered by a predetermined distance. Then, belt 14 stops again. Printer head 2 recommences image formation while moving in the direction perpendicular to the paper plane of FIG. 1. Thus, printing onto paper sheet P is carried out by the alternate operation of image formation by printer head 2 and transportation of paper sheet P by belt drive device 1.

When printing onto paper sheet P is entirely completed, paper sheet P is discharged to the output side (left side in FIG. 1) of belt drive device 1. By repeating the above operation, image formation is carried out continuously on a plurality of paper sheets P.

Advantage of Present Embodiment

By virtue of the formation of rows of holes corresponding to each sheet size at belt 14, both ends of paper sheet P in the width direction can be drawn by corresponding rows of holes to be held favorably towards belt 14 no matter what size the transported paper sheet P is. Upward curling of paper sheet P can be prevented. The problem of paper sheet P being brought into contact with printer head 2 to be contaminated or generation of sheet jamming to prevent a favorable printing operation can be eliminated. Particularly in the case where a relatively small recording medium (post card or B5-size sheet) that has the tendency of lower suction force is transported, both end portions can be held favorably towards belt 14 to effectively prevent generation of curling. Since a sheet transportation operation and halt operation are carried out alternately in a serial type printer head 2 as in the present embodiment, the side end of sheet P must adhere reliably to belt 14 in order to ensure transportation at high accuracy.

According to the present embodiment, the attachment force can be increased by means of suction holes 14*a* of belt 14 corresponding to both side ends of sheet P in addition to increase of the suction force. The suction force depends upon the diameter dimension of suction hole 14*a* and the negative pressure in platen chamber 5. The attracted force depends on the negative pressure in platen chamber 5 and the contacting area between belt 14 and paper sheet P (called "contacting area" hereinafter). The attracted force greatly affects the air resistance between belt 14 and paper sheet P and the air resistance in the direction of the thickness of paper sheet P. If the air resistance in the thickness direction of paper sheet P is greater than the air resistance between belt 14 and paper sheet P, the negative pressure in platen chamber 5 will pervade widely between belt 14 and paper sheet P (the area corresponding to the pervasion of this negative pressure is referred to as "effective area" hereinafter). Therefore, the attachment force of sheet P with respect to belt 14 increases. By setting suction holes 14*a* of belt 14 in correspondence with both side portions of paper sheet P, curling at either side portion can be suppressed. By the correspondence of both sides, the effective area becomes larger than the case where correspondence is not effected although the contacting area is the same. As a result, the attachment between belt 14 and paper sheet P can be increased significantly with a small cost. The present embodiment corresponds to such a demand. Position shifting between paper sheet P and belt 14 can be prevented to improve the picture quality of the image formed on paper sheet P.

Second Embodiment

In contrast to the previous first embodiment in which both side end portions in the width direction of paper sheet P are drawn, the present second embodiment is directed to draw the leading edge portion of paper sheet P in the direction of transportation to suppress curling at that leading edge portion.

Figure 4:
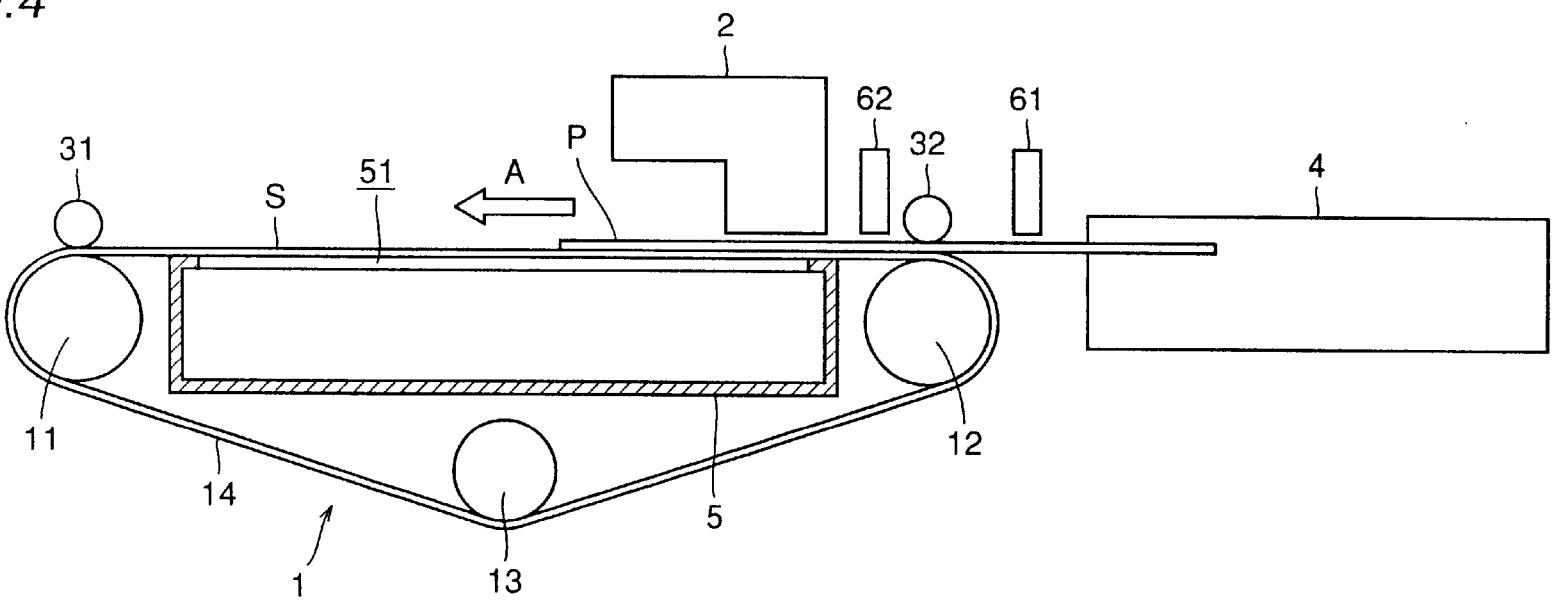
FIG. 4 is a diagram according to a second embodiment of the present invention, corresponding to FIG. 1.
Figure 5:
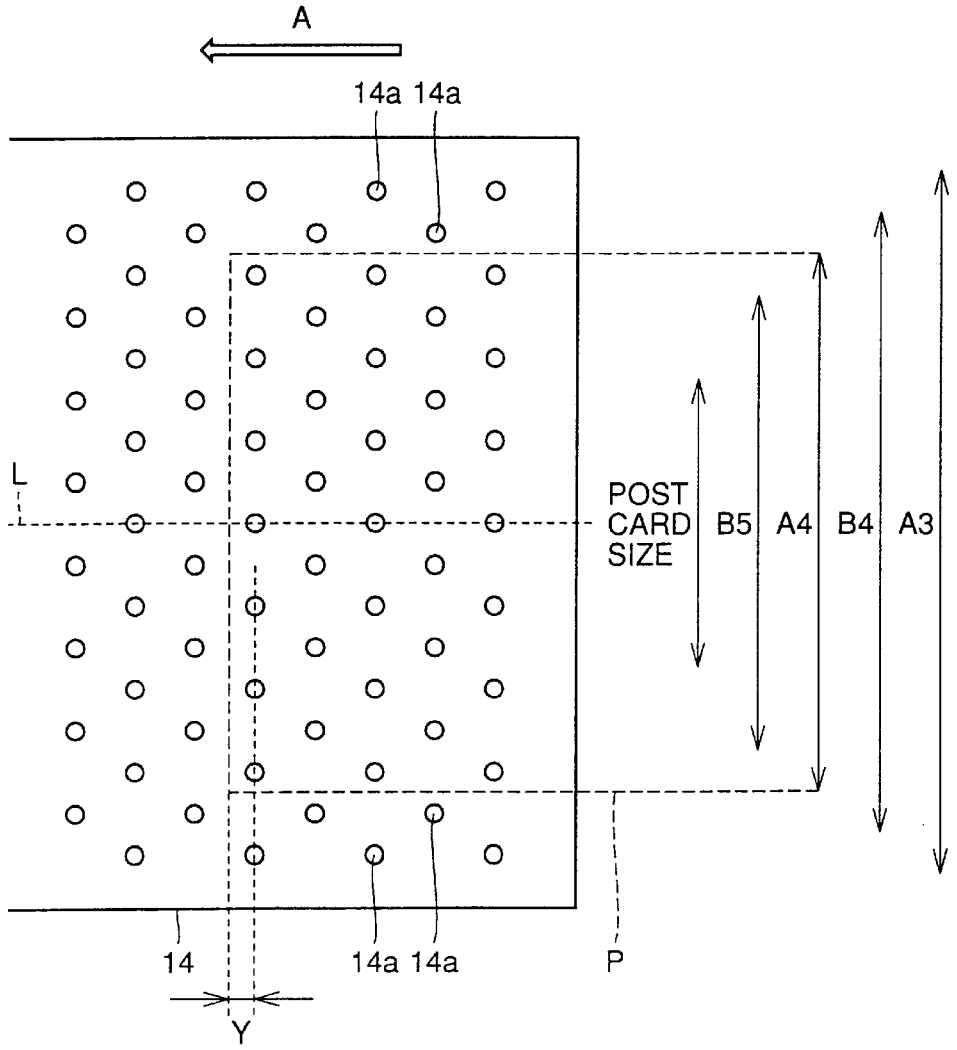
FIG. 5 is a plan view of a belt of the second embodiment.

Referring to FIG. 4, a belt drive device 1 of the second embodiment includes sensors 61 and 62 at both sides of pinch roller 32 in the transportation direction (left and right sides in FIG. 4) above driven roller 12. The sensor upstream of pinch roller 32 (right side in FIG. 4) is a sheet sensor 61 to detect the leading edge of the passing paper sheet P. The sensor downstream of pinch roller 32 (left side in FIG. 4) is a suction hole sensor 62 to detect the position of suction hole 14*a* of belt 14. Suction hole sensor 62 is disposed at a position remote from pinch roller 32 by a predetermined dimension. Upon detection of the position of suction hole 14*a* by suction hole sensor 62, the operation of drive roller 11 is suppressed. Suction hole 14*a* is positioned right beneath suction hole sensor 62. In this state, paper sheet P output from sheet feed cassette 4 is supplied between pinch roller 32 and belt 14. In the subsequent drive of drive roller 11, suction hole sensor 62 is disposed at the position where the leading edge of paper sheet P faces a suction hole 14*a* (for example, the suction hole located adjacent (right side in FIG. 4) in the longitudinal direction of the belt to suction hole 14*a* positioned right below suction hole sensor 62). Specifically, suction hole sensor 62 is set so that suction hole 14*a* is located at a position approximately 0–10 mm (dimension y in FIG. 5) from the leading edge of paper sheet P. Sensors 61 and 62 are the transmittive type or reflective type optical system.

During the printing operation carried out by the printer in the second embodiment, suction sensor 62 detects the position of suction hole 14*a* to position suction hole 14*a* right below suction hole sensor 62. In this state, paper sheet P output from sheet feed cassette 4 is supplied between pinch roller 32 and belt 14. Upon detection of the supply of paper sheet P by sheet sensor 61, drive roller 11 is driven. Accordingly, the leading edge of paper sheet P faces the plurality of suction holes 14*a*, 14*a*, . . . arranged linearly orthogonal to the transportation direction. By the suction force generated at suction holes 14*a*, 14*a*, . . . , paper sheet P is advanced held adhering to belt 14. Therefore, the leading edge of paper sheet P will not float off belt 14. In other words, paper sheet P is transported on belt 14 without the leading edge portion curling upwards.

In the case where a plurality of paper sheets P are transported continuously, the first paper sheet P is set so that the leading edge faces suction hole 14 to suppress that portion from floating off belt 14. The foregoing operation does not have to be necessarily carried out for the second paper sheet P and et seq. This is because only suction holes 14*a*, 14*a*, . . . of belt 14 located below the first paper sheet P are occluded in drawing the first paper sheet P by suction. There is a possibility that sufficient suction force cannot be obtained since the suction resistance at suction hole 14*a* of belt 14 is small and the negative pressure in platen chamber 5 is relatively low. Therefore, curling must be prevented effectively by the foregoing operation. In the transportation from the second paper sheet P onward, another paper sheet (paper sheet P advanced downstream of belt 14) is currently transported to occlude the plurality of suction holes 14*a*, 14*a*, . . . . Therefore, the suction resistance at suction hole 14*a* of belt 14 is relatively increased and the negative pressure in platen chamber 5 can be relatively high. This means that sufficient suction force can be achieved. The foregoing operation to prevent generation of curling does not have to be necessarily carried out for the second paper sheet P and et seq since sufficient suction force can be obtained.

The present embodiment is directed to draw the leading edge portion of paper sheet P in the transportation direction to suppress curling at that region. By setting the trailing edge of paper sheet P in the transportation direction so as to face suction hole 14*a* by means of a similar structure, curling at the trailing edge portion of paper sheet P can be suppressed.

The leading edge and trailing edge portions of paper sheet P in the transportation direction can be both drawn to suppress curling at both edges.

Third Embodiment

The third embodiment has a specific pitch for suction holes 14*a*, 14*a*, . . . formed in belt 14 in the belt running direction. The remaining elements are similar to those of the above-described second embodiment.

The pitch of suction holes 14*a*, 14*a*, . . . is set to "1/an integer times" the dimension of paper sheet P in the transportation direction. For example, when the pitch is set to "1/10 times" the dimension of paper sheet P in the transportation direction, the tenth suction hole 14*a* from suction hole 14*a* facing the leading edge of paper sheet P upstream of the transportation direction will correspond to the trailing edge of paper sheet P.

In the transportation status where the leading edge of paper sheet P is located opposite suction hole 14, the trailing edge portion of this paper sheet P can also be set opposite suction hole 14*a*. Therefore, by identifying only the leading edge of paper sheet P and setting this portion so as to face suction hole 14*a*, the trailing edge can also be located opposite suction hole 14*a* without having to identify the trailing edge of paper sheet P. Both the leading and trailing edge portions of paper sheet P can be drawn to suppress curl generation at both edge portions.

Fourth Embodiment

The fourth embodiment has different sizes for suction holes 14*a* formed at belt 14. The remaining elements are similar to those of the first embodiment.

Figure 6:
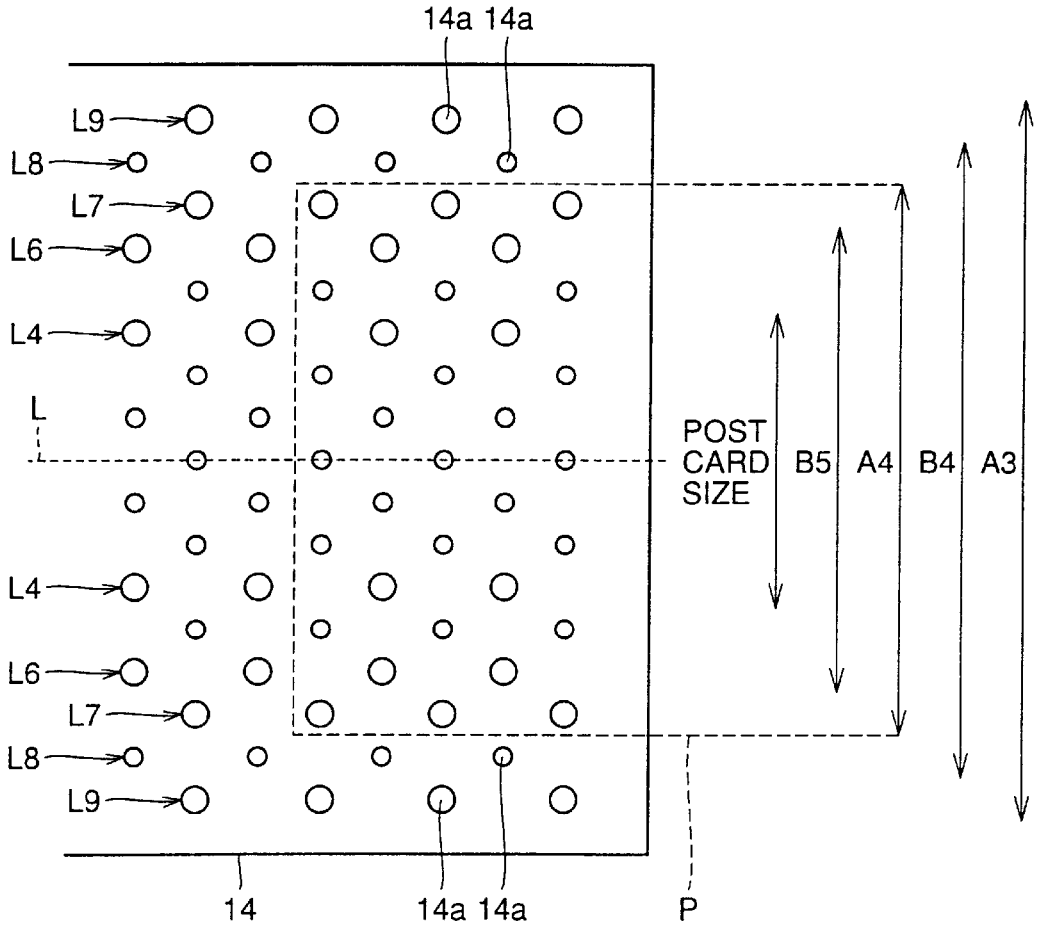
FIG. 6 is a plan view of a belt according to a fourth embodiment of the present invention.

As shown in FIG. 6, belt 14 of the present embodiment has the size of suction holes 14*a* forming a row of holes at relative positions corresponding to each sheet size set larger than that of other suction holes 14*a*. More specifically, suction holes 14*a* of the fourth row of holes L4, L4 corresponding to the post card size, suction holes of the sixth rows L6, L6 corresponding to the B5-size, suction holes of the seventh rows of L7, L7 corresponding to the A4-size, and suction holes of the ninth rows of L9, L9 corresponding to the A3-size are set larger (for example, the diameter is twofold) than other suction holes.

According to the present invention, just side end portions of paper sheet P can adhere to belt 14 by a particularly large suction force. This is because the suction force is increased as the opening area of suction hole 14*a* is larger. By setting a large size of suction holes 14*a* that may correspond to the side end portions of paper sheet P, the side end portions can reliably adhere to belt 14. Thus, curl generation can be prevented definitely.

Figure 7:
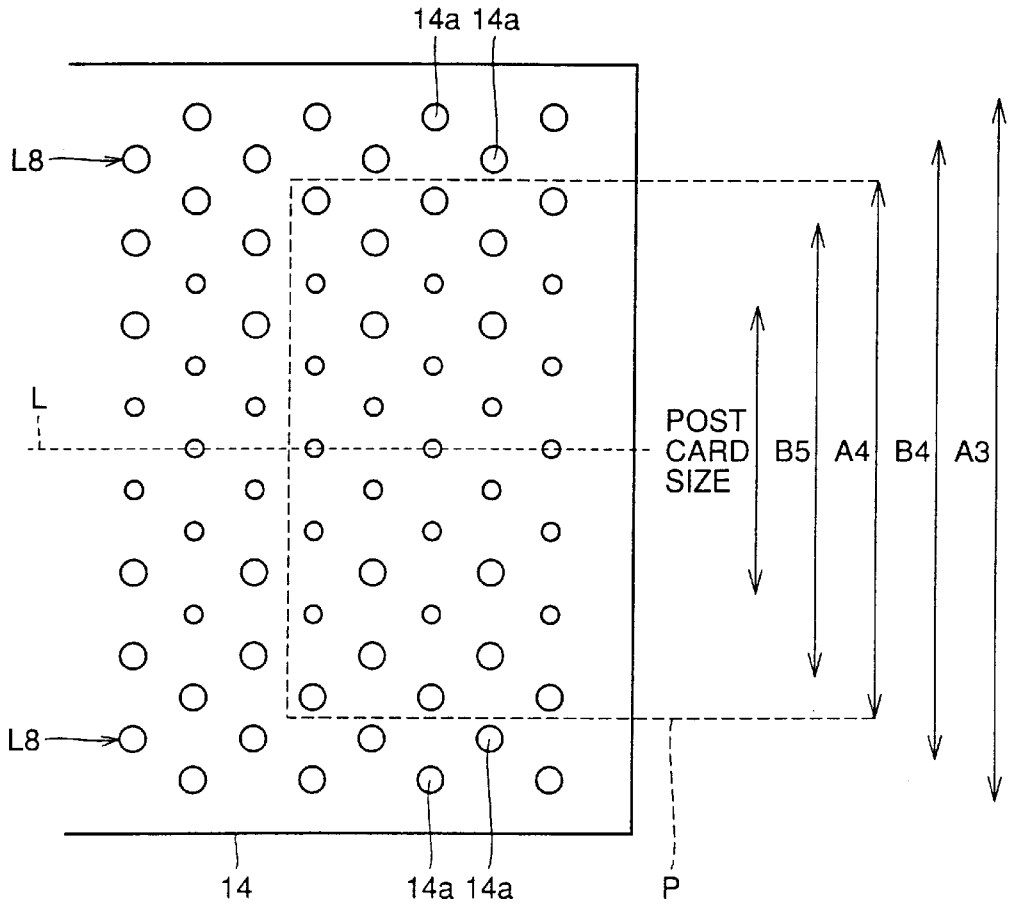
FIG. 7 is a plan view of a belt of the fourth embodiment according to a modification.

In the present embodiment, suction holes 14*a* of the eighth rows L8, L8 corresponding to the B4-size are set to a small diameter. However, suction holes 14*a* of the eighth rows L8, L8 can be set to have a large size, as shown in FIG. 7.

Figure 8:
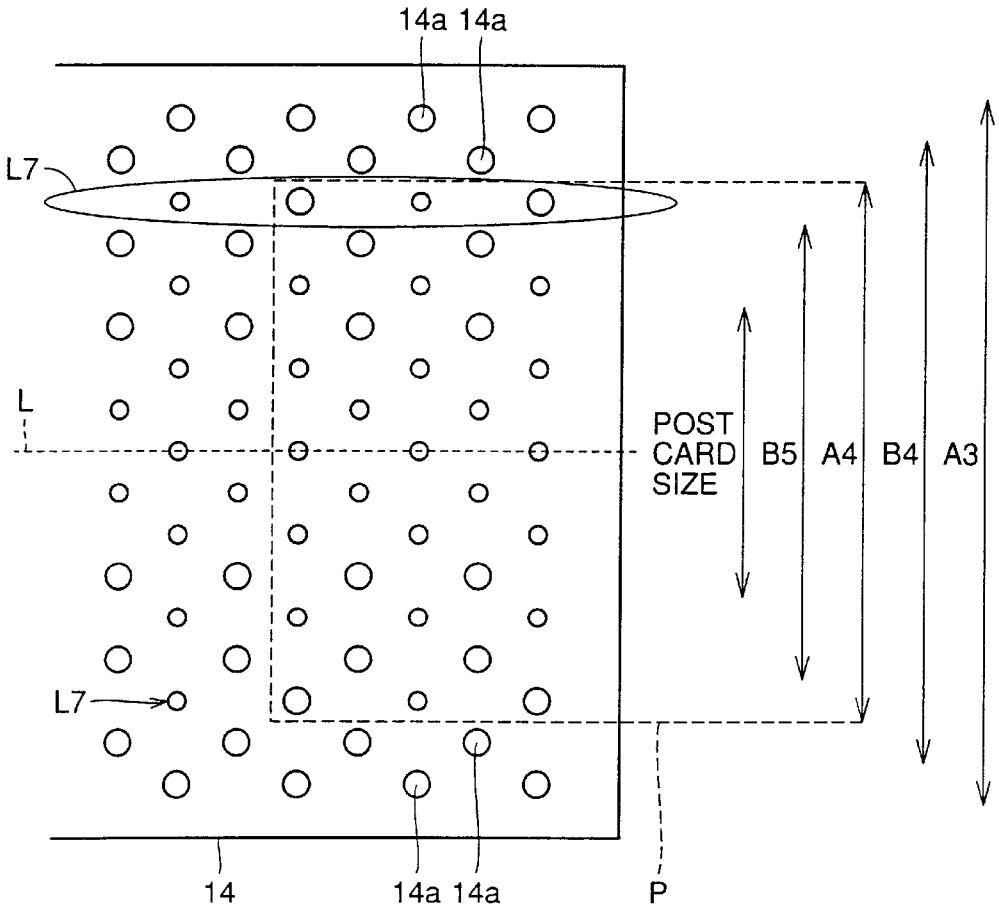
FIG. 8 is a plan view of a belt of the fourth embodiment according to another modification.

FIG. 8 shows the arrangement of suction holes 14*a*, 14*a*, . . . in which the seventh rows L7, L7 corresponding to the A4-size have a suction hole 14*a* of large diameter and a suction hole of a smaller diameter provided alternately. The other rows may also have the suction holes arranged alternately with a large diameter and a small diameter.

The size of suction holes on the same row is not limited to two types, and three or more types of sizes for suction holes are allowed.

Fifth Embodiment

The present embodiment is directed to have the total opening area of suction holes 14*a*, 14*a*, . . . of each row formed at belt 14 different for each row. The remaining elements are similar to those of the first embodiment.

Figure 9:
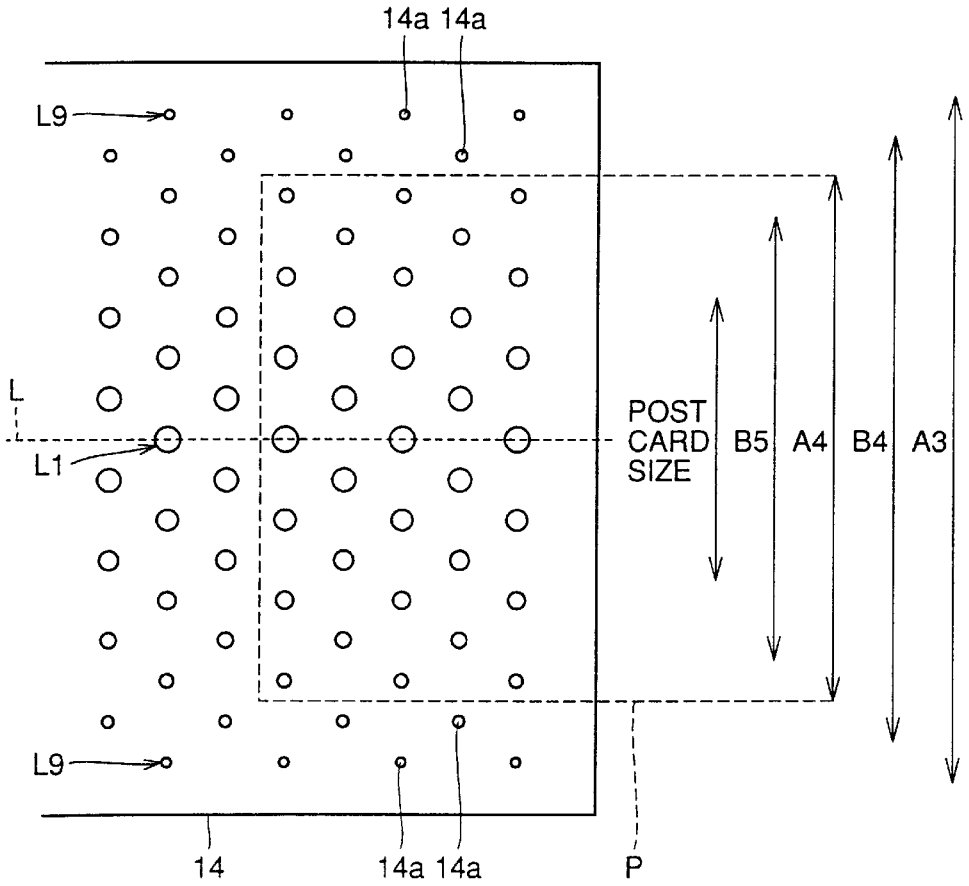
FIG. 9 is a plan view of a belt according to a fifth embodiment of the present invention.

Suction holes 14*a*, 14*a*, . . . are formed so that their opening area becomes smaller as a function of distance from transportation reference line L, as shown in FIG. 9. More specifically, the opening area of each of suction holes 14*a*, 14*a*, . . . in the first row L1 is largest without change in pitch. The opening area of suction holes 14*a*, 14*a*, . . . of ninth row L9 is smallest.

Even in the case where a relatively small paper sheet P such as the post card size is to be transported, the total area of suction holes 14*a*, 14*a*, . . . occluding paper sheet P can be set relatively large. In other words, a greater negative pressure can be effected in platen chamber 5 to generate sufficient suction force. In the case where a relatively large paper sheet P such as A3 in size is to be transported, a large negative pressure can be attained in certain chamber 5 since the total area of suction holes 14*a*, 14*a*, . . . occluding this type of paper sheet P is inherently large. In other words, sufficient suction force can be achieved for a paper sheet P of any size without the inconvenience caused by the smaller opening area of suction holes 14*a*, 14*a*, . . . set as a function of distance from transportation reference line L.

The present invention is not limited to the present embodiment in which the opening area of suction holes 14*a*, 14*a*, . . . is set smaller as a function of distance from transportation reference line L. The opening area of suction holes 14*a*, 14*a*, . . . can be set larger as a function of distance from transportation reference line L.

Figure 10:
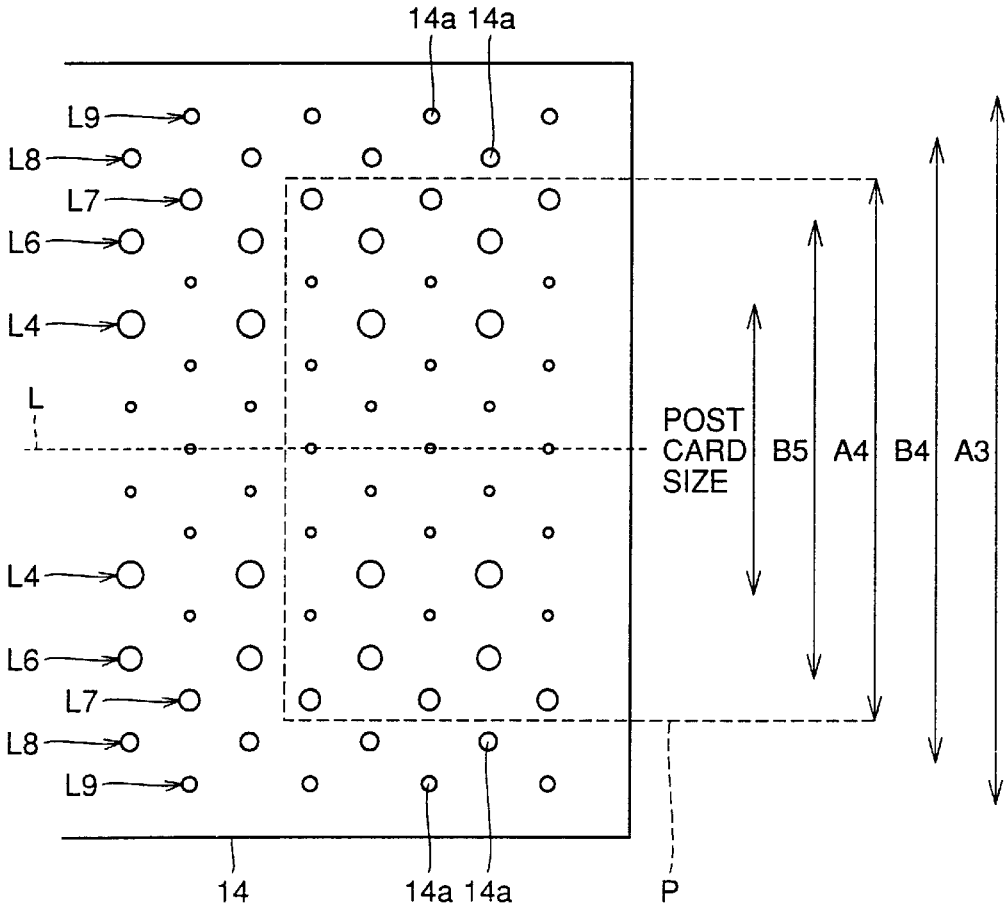
FIG. 10 is a plan view of a belt of the fifth embodiment according to a modification.

Furthermore, only suction holes 14*a* forming rows corresponding to each sheet size can have a smaller opening area of suction holes 14*a*, 14*a*, . . . as a function of distance from transportation reference line L, as shown in FIG. 10. More specifically, the opening area of suction holes 14*a*, 14*a*, . . . of the fourth row L4, the sixth row L6, the seventh row L7, the eighth row L8 and the ninth row L9 is altered.

Figure 11:
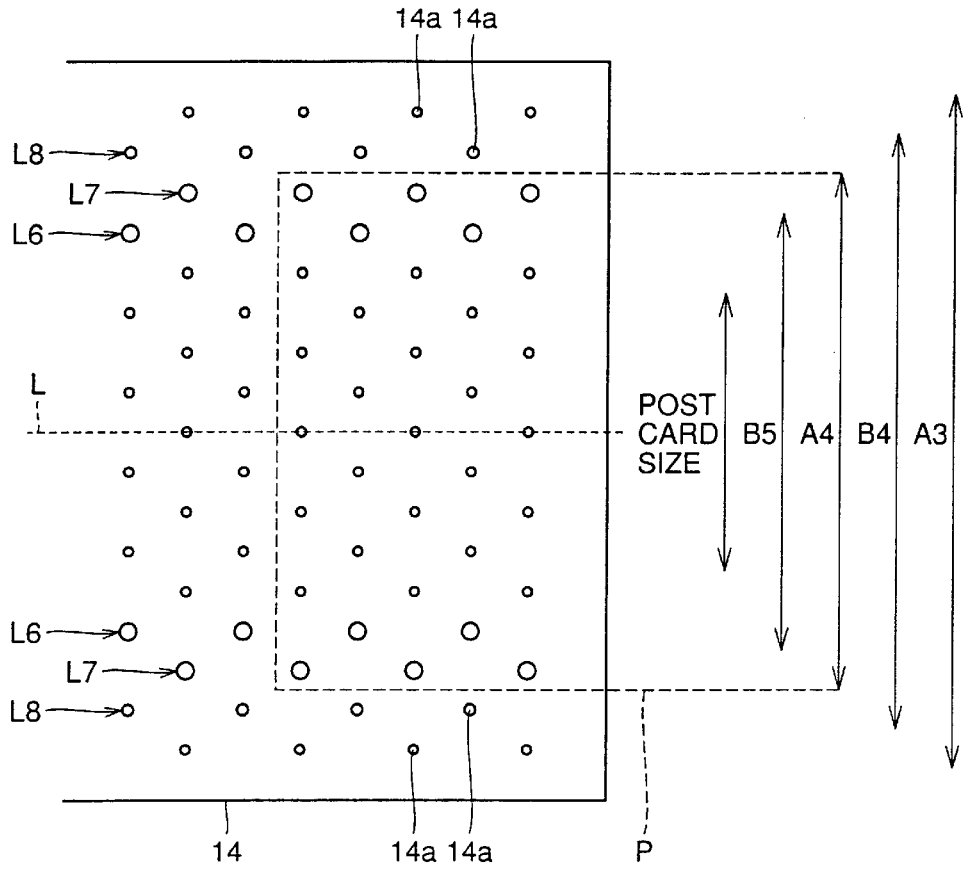
FIG. 11 is a plan view of a belt of the fifth embodiment according to another modification.

Furthermore, suction holes 14*a* of a desired row can be set intentionally to be of the same configuration or of a larger diameter with respect to an adjacent row of suction holes 14*a*, 14*a*, . . . . An example is shown in FIG. 11. With respect to suction holes 14*a*, 14*a*, . . . . of the seventh row L7, suction holes 14*a*, 14*a*, . . . of the sixth row L6 located inward are set to have the same configuration whereas suction holes 14*a*, 14*a*, . . . of the eighth row L8 located outwards are set to have a smaller diameter.

Miscellaneous Embodiments

Figure 12:
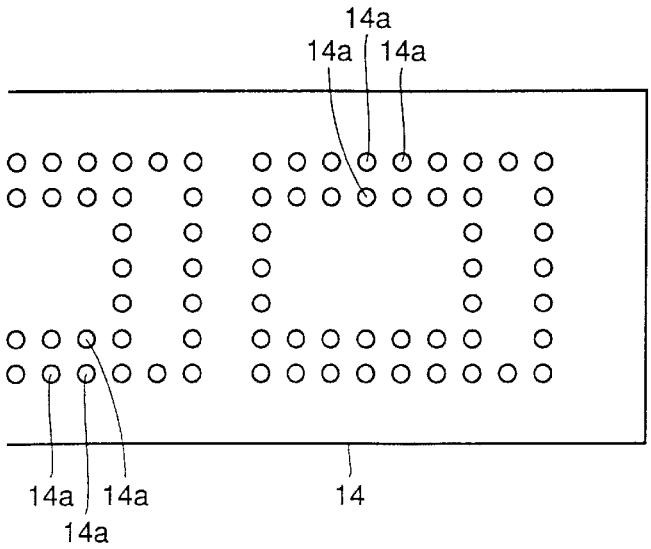
FIG. 12 is a plan view of a belt according to a modification of miscellaneous embodiments.
Figure 13:
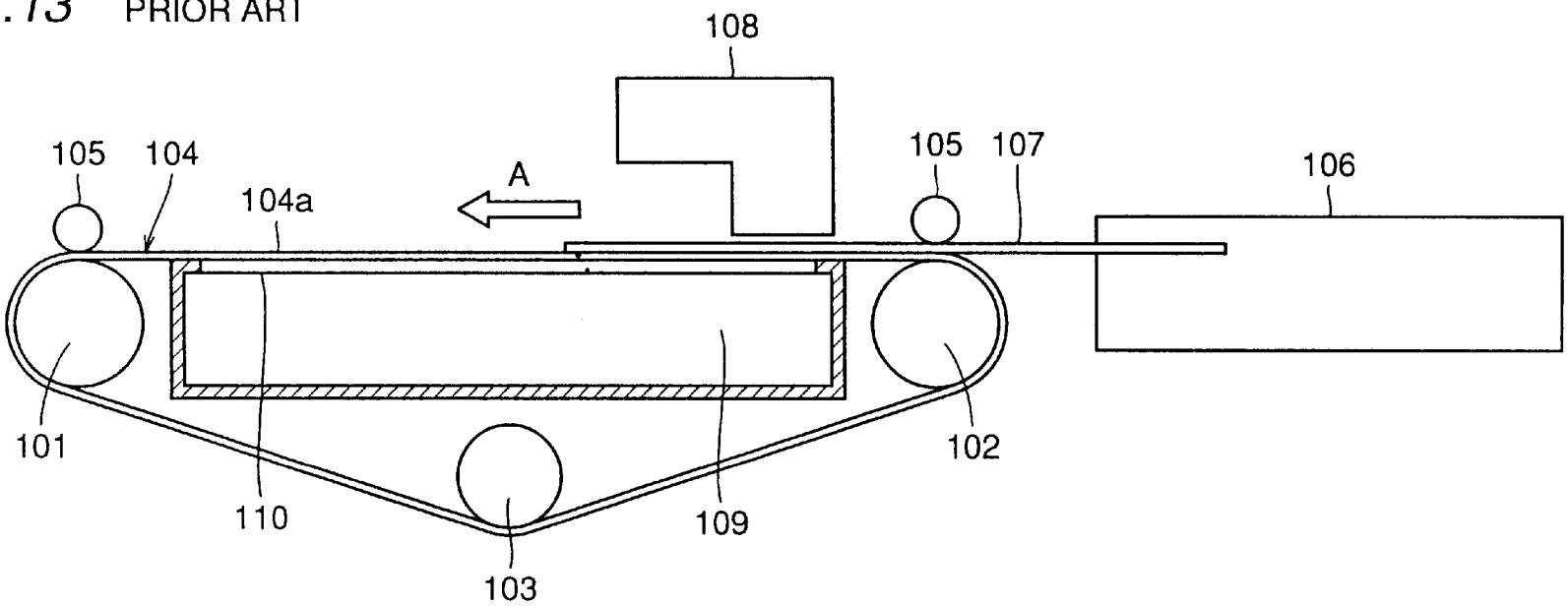
FIG. 13 PRIOR ART
FIG. 13 shows a conventional printer, corresponding to FIG. 1.

The above-described embodiments have suction holes 14*a*, 14*a*, . . . formed over substantially the entire surface of belt 14, wherein a portion of suction holes 14*a*, 14*a*, . . . is set to face the side end of paper sheet P so that this region is attracted. The present invention is not limited to the above-described embodiments. A structure can be employed that has suction holes formed only at the region corresponding to the side end of paper sheet P such that all the suction holes of belt 14 face the side end of paper sheet P to draw that portion. The suction hole can be formed at a position facing the side end along the entire circumference of paper sheet P, at a position facing a side end parallel to the transportation direction of paper sheet P, at a position facing the side end of the leading edge in the transportation direction of paper sheet P, or at a position corresponding to the side end of the trailing edge in the transportation direction of the paper sheet P such that an arbitrary side end is attracted. In this case, the suction holes are formed at the region facing the side end of paper sheet P corresponding to each size of paper sheet P to transport a paper sheet P of different sizes, as in the above described embodiments. For example, the embodiment shown in FIG. 12 has suction holes 14*a*, 14*a*, . . . located at a position corresponding to the side end along the entire circumference of respective paper sheets P in transporting two different sized sheets P.

The above-described embodiments correspond to the case where the present invention is applied to an ink jet printer including a serial type head. The present invention is also applicable to a printer including a line type head or the electrophotographic type printer. The present invention is also applicable to an image recording apparatus other than the printer such as a copy machine. Furthermore, the recording medium is not limited to a paper sheet P, and a medium of various types such as a film can be employed.

In the above embodiments, drive roller 11, driven roller 12 and platen chamber 5 are arranged so that respective top ends are located on one straight line. The present invention is not limited to this arrangement. The top end of platen chamber 5 can be disposed slightly below with respect to the top ends of drive roller 11 and driven roller 12.

As a way of example, suction holes 14*a*, 14*a*, . . . are located to face a position 5 mm from the side end of paper sheet P. Generation of curling can be prevented sufficiently by setting suction holes 14*a*, 14*a*, . . . to face a position approximately 0–10 mm from the side end of paper sheet P.

The above-embodiments have been described corresponding to the case where paper sheet P is transported in a position mounted at the center of the belt width direction. The present invention is also applicable to the case where paper sheet P is transported in a state placed closer to one side of the belt width direction. In this case, transportation reference line L will be located closer to one side in the belt width direction. Accordingly, each row of holes will be set closer to one side in the belt width direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A recording medium transportation apparatus comprising:

a suction chamber, and a transportation belt having a surface including a pair of side edges substantially parallel to a direction of movement of said transportation belt for transporting a recording medium of any one of a plurality of preselected dimensions placed substantially centrally on said surface between said side edges of said transportation belt, and defining a plurality of suction holes connecting said surface to said suction chamber such that air may be introduced into said suction chamber through said holes, wherein said suction holes in said transportation belt are located at positions such that at least some of said holes face and draw each side edge portion of a recording medium having one of said plurality of preselected recording medium dimensions placed on said transportation belt against said surface.

2. The recording medium transportation apparatus according to claim 1, further comprising at least one roller for driving said transportation belt, wherein said transportation belt is an endless transportation belt, and said endless transportation belt defines a span adapted for receiving and transporting a recording medium having any one of said preselected dimensions.

3. The recording medium transportation apparatus according to claim 2, wherein said plurality of suction holes form a plurality of hole rows arranged linearly substantially parallel to said direction of movement of said transportation belt.

4. The recording medium transportation apparatus according to claim 3, wherein a plurality of hole rows are formed in said transportation belt, and at least one of said hole rows has suction holes of a large size and a small size arranged alternately in said movement direction of said transportation belt.

5. The recording medium transportation apparatus according to claim 3, wherein said suction chamber includes a surface facing said transportation belt, an interior portion, and a plurality of suction holes connecting the interior portion of said suction chamber to the surface thereof, and wherein each of said plurality of suction holes in said suction chamber is elongated in the movement direction of said transportation belt and is arranged in spaced apart relation with adjacent ones of said suction holes in said suction chamber in a direction substantially perpendicular to said movement direction of said transportation belt.

6. The recording medium transportation apparatus according to claim 5, wherein the separation between the suction holes in the surface of said suction chamber is substantially the same as the separation between the hole rows defined by said transportation belt.

7. The recording medium transportation apparatus according to claim 2, wherein said plurality of suction holes form a plurality of hole rows arranged linearly substantially perpendicular to said direction of movement of said transportation belt.

8. The recording medium transportation apparatus according to claim 7, wherein a plurality of hole rows are formed in said transportation belt, and a total opening area of suction holes of at least one of said hole rows differs from the total opening area of suction holes of another of said hole rows.

9. The recording medium transportation apparatus according to claim 8, wherein a total opening area of suction holes of at least one said hole row is larger than the total opening area of suction holes of another said hole row.

10. The recording medium transportation apparatus of claim 9, wherein the total opening area of suction holes in each of said plurality of hole rows decreases as the location of the hole row approaches one of said side edges of said endless transportation belt.

11. The recording medium transportation apparatus according to claim 7, wherein a plurality of hole rows are provided in said transportation belt and said hole rows are arranged relative to said movement direction of said transportation belt such that the spacing of suction holes in the direction of movement of said transportation belt is substantially equal to 1/an integer times a side edge dimension of the recording medium to be transported by said transportation belt.

12. The recording medium transportation apparatus according to claim 2, wherein said plurality of suction holes are arranged in a staggered pattern.

13. The recording medium transportation apparatus according to claim 2, further comprising image formation means for forming an image on a recording medium transported on said span.

14. The recording medium transportation apparatus according to claim 1, wherein a suction hole of said transportation belt is formed to face a position apart from a side end of an advancing recording medium inward by a predetermined distance.

* * * * *